US006191677B1

(12) United States Patent
Orben et al.

(10) Patent No.: US 6,191,677 B1
(45) Date of Patent: Feb. 20, 2001

(54) INDUCTANCE ELEMENT

(75) Inventors: Bernhard Orben, Trostberg; Richard Koeppl, Saaldorf; Rene Twardzik; Jerzy Cierpinski, both of Traunreut; Olaf Busse; Martin Grabner, both of Munich; Thomas Eckhard, Traunreut; Cristian Bahr, Traunstein, all of (DE)

(73) Assignee: Patent-Treuhand-Gesellschaft fuer elktrische Gluehlampen mbH, Munich (DE)

( * ) Notice: Under 35 U.S.C. 154(b), the term of this patent shall be extended for 0 days.

(21) Appl. No.: 09/345,386

(22) Filed: Jun. 30, 1999

(30) Foreign Application Priority Data

Jul. 2, 1998 (DE) ..... 198 29 505

(51) Int. Cl.[7] ..... H01F 27/30
(52) U.S. Cl. ..... 336/198; 336/185; 336/195
(58) Field of Search ..... 336/198, 192, 336/195, 196, 185, 207, 208, 206

(56) References Cited

U.S. PATENT DOCUMENTS 4,596,974 * 6/1986 Tobben et al. ..... 336/198
5,220,304 * 6/1993 Ho ..... 336/192
5,369,389 * 11/1994 Schrammek et al. ..... 336/206
5,404,123 * 4/1995 Joseph ..... 336/192
5,696,477 * 12/1997 Yamamori et al. ..... 336/192
5,815,061 * 9/1998 Ho ..... 336/192

* cited by examiner

*Primary Examiner*—Michael L. Gellner
*Assistant Examiner*—Tuyen Nguyen
(74) *Attorney, Agent, or Firm*—Carlo S. Bessone

(57) ABSTRACT

The invention relates to an coil former and at least one wire winding arranged on the coil former, the coil former (1) having a cylindrical sleeve (1*a*) whose cylinder axis runs parallel to the winding axis (A—A) of the at least wire winding, and at least two side walls (1*b*, 1*c*) arranged perpendicularly to the winding axis (A—A), and the cylindrical sleeve (1*a*) and the side walls (1*b*, 1*c*) forming at least one winding space for the at least one wire winding (2, 3). According to the invention, the at least two side walls (1*b*, 1*c*) each have at least one shoulder (1*d*, 1*e*), which subdivide the at least one winding space into a non-constricted first region (B1) and into at least one constricted second region (B2). In addition, the inductance element has electrical insulation (5), which bears on the at least one shoulder (1*d*, 1*e*) of the side walls (1*b*, 1*c*) and separates the non-constricted first region (B1) from the at least one constricted second region (B2).

19 Claims, 2 Drawing Sheets

INDUCTANCE ELEMENT

Figure 1:
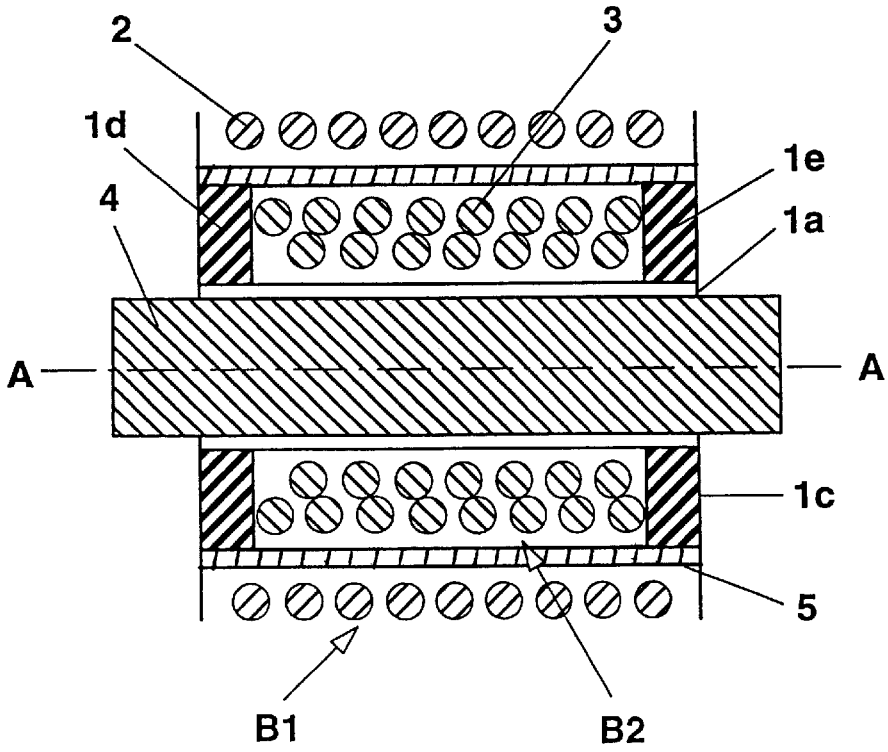

The invention relates to an inductance element in accordance with the preamble of patent claim 1. Inductance elements of this type are known and are already commercially available.

TECHNICAL FIELD

The known inductance elements cited above involve, in particular, transformers and inductors which are suitable for high voltages.

Commercially available transformers have a coil former onto which a primary winding and a secondary winding are wound. The coil former has a chamber which is bounded by two parallel side walls and a cylindrical sleeve and in which the primary winding and the secondary winding are arranged. The cylinder axis of the cylindrical sleeve is identical to the winding axis of the primary and secondary windings. The primary and secondary windings are wound, in a manner separated from one another by one or more electrically insulating layers, about their common winding axis in different layers one above the other. These electrically insulating layers are arranged coaxially with respect to the cylindrical sleeve forming the chamber bottom and extend between the two parallel side walls. Transformers of this type do not have a satisfactory high-voltage endurance. In particular, the small air gap remaining between the side walls of the coil former and the insulating layers can lead to a short circuit between the primary and secondary windings.

Commercially available inductors which are suitable for high voltages have an essentially cylindrical coil former on which a wire winding is arranged. The winding axis of this wire winding runs parallel to the cylinder axis of the coil former. The coil former has a plurality of side walls which are arranged perpendicularly to the cylinder axis and form, along the cylinder axis, different chambers or winding spaces for the turns of the wire winding. In order to ensure a sufficient high-voltage endurance of the inductor, the turns of the wire winding are arranged in different chambers along the cylinder axis of the coil former. However, inductors of this type occupy a comparatively large amount of space.

SUMMARY OF THE INVENTION

The object of the invention is to provide an inductance element in accordance with the preamble of patent claim 1 having an improved high-voltage endurance and a compact spatial arrangement.

This object is achieved according to the invention by means of the characterizing features of patent claim 1. Particularly advantageous embodiments of the invention are described in the subclaims.

The inductance element according to the invention has a coil former and at least one wire winding arranged on the coil former, the coil former having a cylindrical sleeve whose cylinder axis runs parallel to the winding axis of the at least one wire winding, and at least two side walls arranged perpendicularly to the winding axis, with the result that the cylindrical sleeve and the side walls form at least one winding space for the at least one wire winding. According to the invention, the at least two side walls are each equipped with at least one shoulder, which subdivide the at least one winding space into a non-constricted first region and into at least one constricted second region. In addition, the inductance element according to the invention has electrical insulation, which bears on the at least one shoulder or on the at least one step of the at least two side walls and thereby separates the non-constricted first region from the at least one constricted second region. By virtue of the aforementioned measures or features, the high-voltage endurance of the inductance element according to the invention is considerably improved and a compact spatial arrangement of the inductance element is made possible.

It is advantageous for the electrical connections of the inductance element according to the invention to be designed as metal pins anchored in the coil former. These metal pins are connected to the winding ends of the at least one wire winding via connecting wires. At least one of the two side walls of the coil former is advantageously provided with one or more first slots, which are arranged between the metal pins and extend from the edge of the coil former as far as the cylindrical sleeve. Furthermore, at least one of the two side walls is equipped with one or more second slots, which are likewise arranged between the metal pins and extend from the edge of the coil former as far as the at least one shoulder of the corresponding side wall. Moreover, it is advantageous for the first and second slots in each case to have a ramp or an inclined plane, which serve for guiding the connecting wires in the slots.

In a particularly advantageous manner, the invention can be applied to a transformer.

The transformer according to the invention has a coil former onto which at least one first winding and at least one second winding are wound, the first winding and the second winding having a common winding axis and being arranged in different layers, in a manner separated by electrical insulation, one above the other on the coil former. The coil former of the transformer according to the invention has a cylindrical sleeve and at least two side walls which are arranged perpendicularly to the winding axis and form at least one winding space for the transformer windings. The two side walls of the coil former in each case have at least one shoulder, which subdivide the at least one winding space into a non-constricted first region and into at least one constricted second region, and the electrical insulation bears on the at least one shoulder of the side walls and separates the non-constricted first region from the at least one constricted second region. It is advantageous for the at least one first winding to be arranged in the non-constricted first region and the at least one second winding to be arranged in the at least one constricted second region of the at least one winding space of the coil former, with the result that spatial separation of first winding and second winding is achieved by means of the electrical insulation. The invention's shoulders or steps on the side walls enable a compact spatial arrangement of the first and second windings. They improve the high-voltage endurance of the transformer by preventing, in particular, creepage currents and corona or spark discharges at the edges of the electrical insulation between first and second windings. Furthermore, the measures according to the invention allow the use of a comparatively thin plastic strip as the electrical insulation, said strip being arranged between the first and second windings and bearing on the shoulders or steps. The use of this comparatively thin electrical insulation between the first and second windings ensures a compact spatial arrangement and a minimal leakage inductance of the transformer. In order to compensate for small tolerances in the winding height of the first and second windings, the at least one shoulder of the side walls is advantageously provided in each case with a bevel, which ensures a continuous transition from the non-constricted first region to the at least one constricted second region. The first and second slots in the side walls also contribute to improving the high-voltage endurance. In an advantageous manner, the connecting wires for the at least one second winding are guided through the first slots, while the connecting wires of the at least one first winding are threaded through the second slots. The first and second slots improve the electrical insulation between the first and second windings and between the connecting wires of the first and second windings.

DESCRIPTION OF THE PREFERRED EXEMPLARY EMBODIMENT

Figure 2:
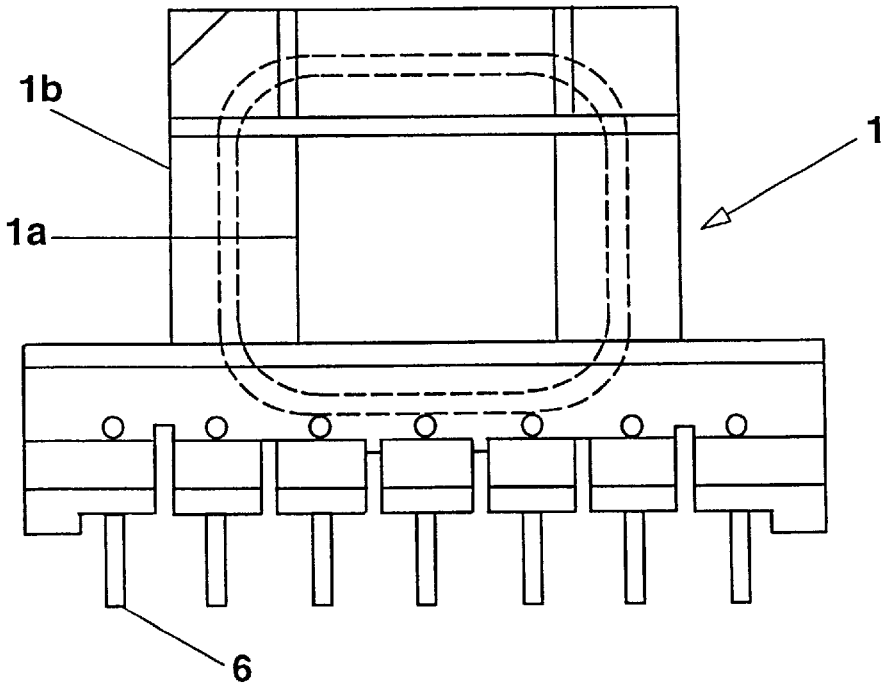
Figure 3:
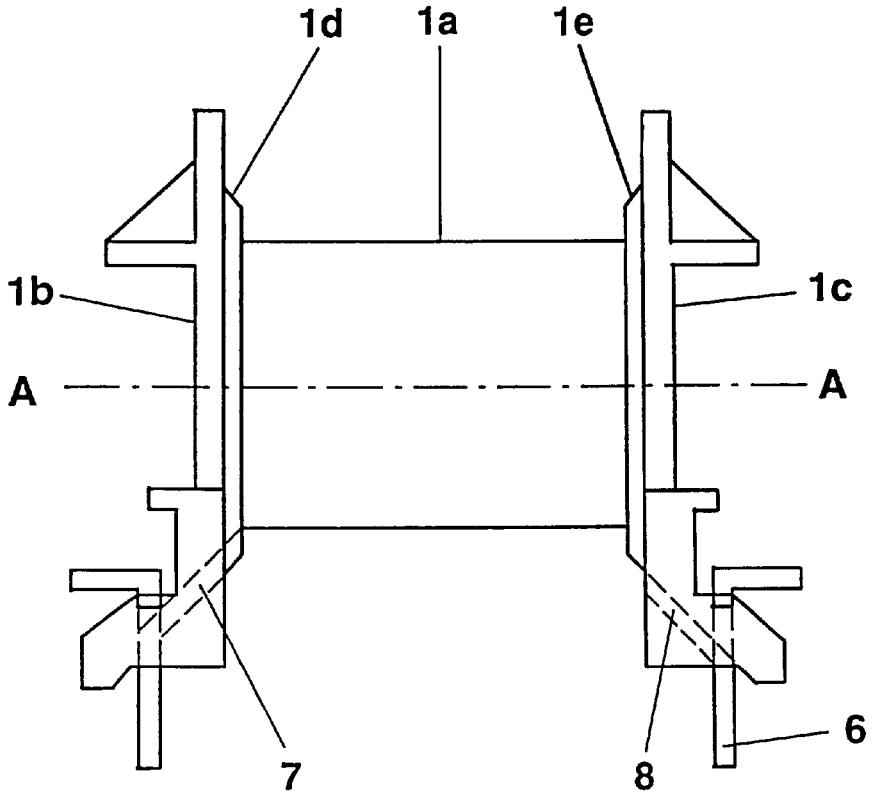
Figure 4:
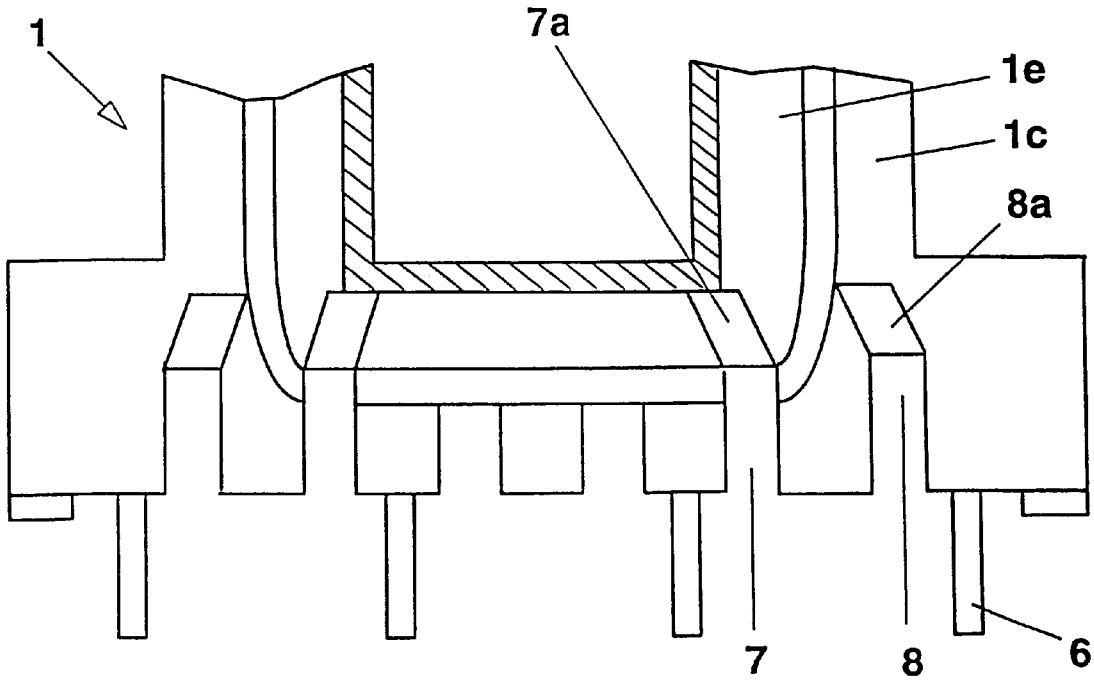

The invention is explained in more detail below using a preferred exemplary embodiment. In the figures:

FIG. 1 shows a cross section through a transformer according to the invention in a diagrammatic illustration, FIG. 2 shows a side view of the coil former of the transformer according to the invention, FIG. 3 shows the coil former of the transformer according to the invention as represented in FIG. 2 in a side view rotated through 90 degrees relative to FIG. 2, and FIG. 4 shows a cross section through the lower part of the coil former with a plan view of the inner side of a side wall and an enlarged illustration of the slots in the side wall.

The preferred exemplary embodiment involves a transformer having a coil former 1 made of plastic, a primary winding 2, a secondary winding 3 and a ferrite or iron core 4. The primary winding 2 and the secondary winding 3 have a common winding axis A—A and are wound in different layers, in a manner separated by electrical insulation 5, one above the other onto the coil former 1. The coil former 1 has a winding space bounded by a cylindrical sleeve 1*a* and two side walls 1*b*, 1*c* arranged perpendicularly to the winding axis A—A. The cylindrical sleeve 1*a* has a square cross section and its cylinder axis runs parallel to the winding axis A—A of the transformer windings 2, 3. This cylindrical sleeve 1*a* forms the bottom of the winding space and encloses the ferrite or iron core 4 of the transformer. The two side walls 1*b*, 1*c* are each provided with a shoulder 1*d*, 1*e* extending into the winding space. These shoulders 1*d*, 1*e* subdivide the winding space into a non-constricted first region B1 and a constricted second region B2 reaching as far as the cylindrical sleeve 1*a*. In other words, the distance between the two side walls 1*b*, 1*c* is smaller in the constricted region B2 than in the non-constricted region B1, on account of the shoulders 1*d*, 1*e*. The primary winding 2 is accommodated in the non-constricted first region B1, while the secondary winding 3 is arranged in the constricted second region B2. The electrical insulation 5 bears on the shoulders 1*d*, 1*e* and spatially separates the primary winding 2 from the secondary winding 3. The electrical insulation 5 comprises a plastic film which encloses the secondary winding 3 in two layers and has a thickness of approximately 3 m. The primary winding 2 is wound onto the coil former 1 over the electrical insulation 5. The primary winding 2 has 55 turns and comprises an enameled multiple-stranded wire with four cores each having a diameter of 0.25 mm. The secondary winding 3 has 154 turns and comprises an enameled multiple-stranded wire with seven cores each having a diameter of 0.25 mm. The secondary winding 3 fills the entire constricted region B2 of the winding space of the coil former 1. The height of the shoulders 1*d*, 1*e* is coordinated with the winding height of the secondary winding 3. The height of the shoulders 1*d*, 1*e*, as measured from the bottom 1*a*, is approximately 3 mm. The distance between the two side walls 1*b*, 1*c* is approximately 20 mm in the non-constricted region and approximately 18 mm in the constricted region. The length of the constricted region is less than the length of the non-constricted region by the thickness of the two shoulders 1*d*, 1*e*. The shoulders 1*d*, 1*e* are designed as ramps, that is to say they each have a bevel in order to compensate for tolerances in the winding height of the secondary winding 3. The cylindrical sleeve 1*a* having a square cross section which forms the bottom 1*a* of the winding space has a diameter or a side length of approximately 12 mm. The height of the side walls 1*b*, 1*c* above the cylindrical sleeve 1*a* is approximately 6 mm.

The transformer furthermore has eleven angular metal pins 6, which are anchored in the coil former 1 and serve for fixing the transformer on a printed circuit board and for making electrical contact with the primary winding 2 and the secondary winding 3. Seven metal pins 6 are anchored in the first side wall 1*b* and four metal pins 6 are anchored in the second side wall 1*c*. The electrical connection between the metal pins 6 and the transformer windings 2, 3 is effected by means of connecting wires, which are each connected to a winding end of the primary winding 2 or of the secondary winding 3 and to one of the metal pins 6. Arranged between the metal pins 6 are two first slots 7 and two second slots 8 in the second side wall 1*c*. The first slots 7 extend from the edge of the coil former 1 as far as the cylindrical sleeve 1*a*. A connecting wire connected to a winding end of the secondary winding 3 is arranged in each of these first slots 7. The first slots 7 serve as a guiding aid for the connecting wires connected to the secondary winding 3. The second slots 8 extend from the edge of the coil former 1 as far as the shoulder le of the side wall 1*c*. A connecting wire connected to a winding end of the primary winding 2 is arranged in each of these second slots 8. These second slots 8 serve as a guiding aid for the connecting wires connected to the primary winding 2. The first 7 and second slots 8 are in each case equipped with a ramp 7*a*, 8*a* or an inclined plane, which facilitates the threading in and guiding of the connecting wires to the winding ends of the primary winding 2 and secondary winding 3.

The invention is not restricted to the exemplary embodiment explained in more detail above. By way of example, the transformer according to the invention may have a plurality of primary and/or secondary windings wound one above the other. In addition, in the case of a plurality of primary and/or secondary windings, the coil former may also be equipped with a plurality of chambers for receiving these windings. Furthermore, the side walls of the chamber or of the chambers may also have a plurality of shoulders which subdivide the chamber or the winding space into a plurality of stepped constricted regions. A transformer winding can be accommodated in each of these stepped constricted regions, and electrical insulation which spatially separates and electrically isolates the abovementioned transformer windings from one another can bear on each of these shoulders. It is also possible, of course, to arrange the primary winding in the constricted region B2 and the secondary winding in the non-constricted region Bl of the coil former.

In addition, it is also possible to apply the invention to an inductor designed for high voltages. The inductor according to the invention has a coil former made of plastic with a cylindrical sleeve and two side walls which are arranged perpendicularly to the cylinder axis of the sleeve and form a chamber or a winding space for a wire winding whose winding axis runs parallel to the cylinder axis. The turns of the wire winding are wound coaxially with respect to the cylinder axis in at least two different layers one above the other onto the coil former. The two side walls in each case have at least one shoulder pointing into the winding space, with the result that the winding space is subdivided into a non-constricted first region and one or more progressively constricted second regions. A layer of turns of the wire winding is accommodated in the first region and in each of the second regions. In addition, the first region and the various second regions are in each case separated from one another by electrical insulation comprising a plastic strip. The electrical insulation bears on the mutually corresponding shoulders or steps of the side walls and separates the turns of the wire winding which are wound in different layers coaxially one above the other. A high-voltage inductor having a spatially compact construction is made possible in this way.

What is claimed is:

1. An inductance element having a coil former and at least one wire winding arranged on the coil former, the coil former (1) having a cylindrical sleeve (1*a*) whose cylinder axis runs parallel to a winding axis (A—A) of the at least one wire winding, and at least two side walls (1*b*, 1*c*) arranged perpendicularly to the winding axis (A—A), and the cylindrical sleeve (1*a*) and the at least two side walls (1*b*, 1*c*) forming at least one winding space for the at least one wire winding (2, 3), wherein the at least two side walls (1*b*, 1*c*) each have at least one shoulder (1*d*, 1*e*), which subdivide the at least one winding space into a non-constricted first region (B1) having a first length along the winding axis (A—A) and into a constricted second region (B2) having a second length along the winding axis, with the second length being less than the first length, and an electrical insulation (5), which rests and bears on the at least one shoulder (1*d*, 1*e*) of the at least two side walls (1*b*, 1*c*) and separates the non-constricted first region (B1) from the constricted second region (B2).

2. The inductance element as claimed in claim 1, wherein the at least one shoulder (1*d*, 1*e*) has a bevel, providing in a continuously transition from the non-constricted first region (B1) to the at least one constricted second region (B2).

3. The inductance element as claimed in claim 1, wherein the inductance element is a transformer having at least one first winding (2) and at least one second winding (3), the at least one first winding (2) and the at least one second winding (3) having the winding axis (A—A) in common, which winding axis runs parallel to the cylinder axis of the cylindrical sleeve (1*a*) of the coil former (1), the at least one first winding (2) and the at least one second winding (3) are layered one above the other on the coil former (1), and the electrical insulation (5) is positioned between the at least one first winding (2) and the at least one second winding (3).

4. The inductance element as claimed in claim 3, wherein the at least one first winding (2) is arranged in the first, non-constricted region (B1) and the at least one second winding (3) is arranged in the at least one constricted second region (B2).

5. The inductance element as claimed in claim 1, wherein the inductance element has electrical connections designed as metal pins (6) anchored in the coil former.

6. The inductance element as claimed in claim 5, wherein the metal contact pins (6) are connected to winding ends of the at least one wire winding (2, 3) via connecting wires.

7. The inductance element as claimed in claim 5, wherein at least one of the at least two side walls (1*b*, 1*c*) has one or more first slots (7), which are arranged between the metal contact pins (6) and extend from an edge of the coil former (1) to the cylindrical sleeve (1*a*) of the at least one winding space.

8. The inductance element as claimed in claim 5, wherein at least one of the at least two side walls (1*b*, 1*c*) has one or more second slots (8), which are arranged between two of the metal contact pins (6) and extend from an edge of the coil former (1) to the at least one shoulder (1*d*, 1*e*) of the corresponding side wall (1*b*, 1*c*).

9. The inductance element as claimed in claim 4, wherein at least one of the at least two side walls (1*b*, 1*c*) has one or more first slots (7) arranged between the metal contact pins (6) and extending from an edge of the coil former (1) to the cylindrical sleeve (1*a*) of the at least one winding space, and connecting wires for the at least one second winding (3) are guided through one of the first slots (7).

10. The inductance element as claimed in claim 4, wherein at least one of the at least two side walls (1*b*, 1*c*) has one or more second slots (8), which are arranged between the metal contact pins (6) and extend from an edge of the coil former (1) to the at least one shoulder (1*d*, 1*e*) of the corresponding side wall (1*b*, 1*c*) , and connecting wires for the at least one first winding (2) are guided through one of the second slots (8).

11. The inductance element as claimed in claim 7, wherein at least one of the at least two side walls (1*b*, 1*c*) has one or more second slots (8), which are arranged between the metal contact pins (6) and extend from an edge of the coil former (1) to the at least one shoulder (1*d*, 1*e*) of the corresponding side wall (1*b*, 1*c*), and the first and/or second slots (7, 8) in each case form a ramp with an inclined plane (7*a*, 8*a*), which inclined planes serve as wire guides.

12. The inductance element as claimed in claim 1, wherein the inductance element is an inductor, the at least one wire winding comprises a first wire winding and a second wire winding, the first and the second wire windings having turns which are wound in at least two layers, the second wire winding forming a first layer located above a second layer formed by the first wire winding, and the electrical insulation is located between the first and second layers formed by the first and second wire windings.

13. The inductance element as claimed in claim 6, wherein the inductance element is a transformer having at least one first winding (2) and at least one second winding (3), at least one of the at least two side walls (1*b*, 1*c*) has one or more first slots (7) arranged between the metal contact pins (6) and extending from an edge of the coil former (1) to the cylindrical sleeve (1*a*) of the at least one winding space, and the connecting wires for the at least one second winding (3) are guided through one of the first slots (7).

14. The inductance element as claimed in claim 7, wherein the inductance element is a transformer having at least one first winding (2) and at least one second winding (3), and connecting wires for the at least one second winding (3) are guided through one of the first slots (7).

15. The inductance element as claimed in claim 6, wherein the inductance element is a transformer having at least one first winding (2), and connecting wires for the at least one first winding (2) are guided through one of the second slots (8).

16. The inductance element as claimed in claim 8, wherein the inductance element is a transformer having at least one first winding (2), and connecting wires for the at least one first winding (2) are guided through one of the second slots (8).

17. The inductance element as claimed in claim 8, wherein at least one of the at least two side walls (1*b*, 1*c*) has one or more first slots (7) , which are arranged between the metal contact pins (6) and extend from the edge of the coil former (1) to the cylindrical sleeve (1*a*) of the at least one winding space and, the first and/or second slots (7, 8) in each case form a ramp with an inclined plane (7*a*, 8*a*), which ramps serve as wire guides.

18. An transformer comprising:

a coil former;

two wires wound around the coil former; and an electrical insulation positioned intermediate the two wires, the coil former having a cylindrical sleeve with a cylinder axis running parallel to a winding axis of the two wires, and two side walls arranged perpendicularly to the winding axis, each of the two walls having a shoulder, the cylindrical sleeve and the shoulders of the two side walls forming an inner winding space of a first length along the winding axis, a first of the two wires filling the inner winding space, the electrical insulation resting on an entire length of the shoulders of the two side walls and separating the first of the two wires from a second of the two wires, the entire length of the electrical insulation and the a portion of the two side walls apart from the shoulders forming an outer winding space of a second length along the winding axis, a second of the two wires filling the outer winding space, the first length being less that the second length.

19. An transformer comprising:

a coil former having a cylindrical sleeve with a cylinder axis running parallel to a wire winding axis, and two side walls arranged perpendicularly to the winding axis, the two side walls having a shoulder portion and a non-shoulder portion, the cylindrical sleeve and the shoulder portions of the two side walls defining an inner wire winding space with a first length along the wire winding axis;

an electrical insulation positioned along an upper surface area of the shoulder portions of the two side walls, the electrical insulation and the non-shoulder portions of the two side walls defining a outer wire winding space with a second length along the wire winding axis, the second length being greater than the first length;

a first wiring filling the inner wire winding space; and a second wiring arranged along an entire length of the electrical insulation and filling the outer wire winding space.

* * * * *